US009953752B2

(12) United States Patent
Shingaki et al.

(10) Patent No.: US 9,953,752 B2
(45) Date of Patent: Apr. 24, 2018

(54) PRODUCTION METHOD FOR GRAIN-ORIENTED ELECTRICAL STEEL SHEET AND PRIMARY RECRYSTALLIZED STEEL SHEET FOR PRODUCTION OF GRAIN-ORIENTED ELECTRICAL STEEL SHEET

(71) Applicant: JFE STEEL CORPORATION, Tokyo (JP)

(72) Inventors: Yukihiro Shingaki, Kurashiki (JP); Hiroi Yamaguchi, Kurashiki (JP); Yuiko Wakisaka, Kurashiki (JP); Hiroshi Matsuda, Chiba (JP); Takashi Terashima, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/650,378

(22) PCT Filed: Dec. 25, 2013

(86) PCT No.: PCT/JP2013/085322
§ 371 (c)(1),
(2) Date: Jun. 8, 2015

(87) PCT Pub. No.: WO2014/104394
PCT Pub. Date: Jul. 3, 2014

(65) Prior Publication Data

US 2015/0318094 A1 Nov. 5, 2015

(30) Foreign Application Priority Data

Dec. 28, 2012 (JP) ..... 2012-288877

(51) Int. Cl.
*H01F 1/147* (2006.01)
*C21D 8/12* (2006.01)
(Continued)

(52) U.S. Cl.
CPC ..... *H01F 1/14783* (2013.01); *C21D 6/005* (2013.01); *C21D 6/008* (2013.01);
(Continued)

(58) Field of Classification Search
CPC .. C21D 8/1261; C21D 8/1272; C21D 8/1255; C21D 8/1294; C21D 8/1283;
(Continued)

(56) References Cited

U.S. PATENT DOCUMENTS 1,965,559 A 7/1934 Goss
4,979,997 A 12/1990 Kobayashi et al.
(Continued)

FOREIGN PATENT DOCUMENTS

CN 1256321 A 6/2000
JP S40-015644 B 7/1965
(Continued)

OTHER PUBLICATIONS

Jan. 22, 2016 Office Action issued in Chinese Patent Application No. 201380068115.8.
(Continued)

*Primary Examiner* — Jessee Roe
(74) *Attorney, Agent, or Firm* — Oliff PLC

(57) ABSTRACT

A method for producing grain-oriented electrical steel sheets includes subjecting a steel slab to hot rolling to obtain a hot rolled sheet, the steel slab having a composition consisting of, by mass % or mass ppm, C: 0.08% or less, Si: 2.0% to 4.5% and Mn: 0.5% or less, S, Se, and O: less than 50 ppm each, sol.Al: less than 100 ppm, N: 80 ppm or less, and the balance being Fe and incidental impurities, and satisfying the relation of sol.Al (ppm)−N (ppm)×(26.98/14.00)≤30 ppm; then subjecting the hot rolled sheet to annealing and rolling to obtain a cold rolled sheet; then subjecting the cold rolled sheet to nitriding treatment, under specific condition,
(Continued)

ΔN=100ppm

ΔN=500ppm before, during or after primary recrystallization annealing; then applying an annealing separator on the cold rolled sheet; and subjecting the cold rolled sheet to secondary recrystallization annealing.

2 Claims, 2 Drawing Sheets

(51) Int. Cl.

| | |
|---|---|
| ***C21D 9/46*** | (2006.01) |
| ***C21D 6/00*** | (2006.01) |
| ***H01F 1/18*** | (2006.01) |
| ***H01F 41/02*** | (2006.01) |
| ***H01F 41/00*** | (2006.01) |
| ***C23C 8/26*** | (2006.01) |
| ***C22C 38/60*** | (2006.01) |
| ***H01F 1/16*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/22*** | (2006.01) |

(52) U.S. Cl.
CPC ..... *C21D 8/1222* (2013.01); *C21D 8/1233* (2013.01); *C21D 8/1255* (2013.01); *C21D 8/1261* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/22* (2013.01); *C22C 38/60* (2013.01); *C23C 8/26* (2013.01); *H01F 1/16* (2013.01); *H01F 1/18* (2013.01); *H01F 41/005* (2013.01); *H01F 41/02* (2013.01); *C21D 8/1272* (2013.01)

(58) Field of Classification Search
CPC ..... C21D 8/1222; C21D 8/1233; C21D 9/46; C21D 6/008; C21D 6/005; H01F 1/14783; H01F 1/18; H01F 41/02; H01F 41/005
See application file for complete search history.

(56) References Cited

U.S. PATENT DOCUMENTS

| | | | | |
|---|---|---|---|---|
| 5,643,370 | A * | 7/1997 | Huppi | C21D 8/1255 148/111 |
| 2001/0030001 | A1 | 10/2001 | Hayakawa et al. | |
| 2002/0011278 | A1 | 1/2002 | Komatsubara et al. | |
| 2002/0033206 | A1 * | 3/2002 | Cicale' | C21D 8/1255 148/111 |
| 2008/0216985 | A1 | 9/2008 | Gunther et al. | |
| 2009/0126832 | A1 | 5/2009 | Ushigami et al. | |
| 2009/0139609 | A1 | 6/2009 | Gunther et al. | |
| 2013/0129984 | A1 | 5/2013 | Omura et al. | |
| 2013/0129985 | A1 | 5/2013 | Inoue et al. | |
| 2013/0160901 | A1 | 6/2013 | Omura et al. | |
| 2014/0202599 | A1 * | 7/2014 | Watanabe | C21D 8/12 148/579 |

FOREIGN PATENT DOCUMENTS

| | | | |
|---|---|---|---|
| JP | S51-013469 | B | 4/1976 |
| JP | 2782086 | B2 | 7/1998 |
| JP | H11-335736 | A | 12/1999 |
| JP | H11-335738 | A | 12/1999 |
| JP | 2000-129356 | A | 5/2000 |
| JP | 2001-107147 | A | 4/2001 |
| JP | 2003-049250 | A | 2/2003 |
| JP | 2004-292833 | A | 10/2004 |
| JP | 2006-316314 | A | 11/2006 |
| JP | 2007-314823 | A | 12/2007 |
| JP | 2012-036446 | A | 2/2012 |
| JP | 2012-036447 | A | 2/2012 |
| JP | 2012-077380 | A | 4/2012 |
| KR | 2003-0052348 | A | 6/2003 |
| RU | 2383634 | C2 | 3/2010 |
| RU | 2391416 | C1 | 6/2010 |
| RU | 2407807 | C2 | 12/2010 |
| WO | 2014/104391 | A1 | 7/2014 |

OTHER PUBLICATIONS

Mar. 14, 2016 Extended Search Report issued in European Patent Application No. 13867430.4.
May 11, 2016 Office Action issued in Korean Patent Application No. 10-2015-7019243.
Sep. 1, 2015 Office Action issued in Japanese Patent Application No. 2014-554632.
Nov. 24, 2016 Office Action issued in Russian Patent Application No. 2015131088/02(047901).
Apr. 8, 2014 International Search Report issued in International Application No. PCT/JP2013/085322.
Jan. 22, 2017 Office Action issued in Chinese Patent Application No. 201380068115.8.

* cited by examiner

ΔN=100ppm

ΔN=500ppm

PRODUCTION METHOD FOR GRAIN-ORIENTED ELECTRICAL STEEL SHEET AND PRIMARY RECRYSTALLIZED STEEL SHEET FOR PRODUCTION OF GRAIN-ORIENTED ELECTRICAL STEEL SHEET

TECHNICAL FIELD

The present invention relates to a production method for a grain-oriented electrical steel sheet with excellent magnetic properties which enables obtaining a grain-oriented electrical steel sheet with excellent magnetic properties at low cost, and a primary recrystallized steel sheet for a grain-oriented electrical steel sheet which is suitable for production of such grain-oriented electrical steel sheet.

BACKGROUND

A grain-oriented electrical steel sheet is a soft magnetic material used as an iron core material of transformers, generators, and the like, and has a crystal microstructure in which the <001> orientation, which is an easy magnetization axis of iron, is highly accorded with the rolling direction of the steel sheet. Such microstructure is formed through secondary recrystallization where coarse crystal grains with (110)[001] orientation or the so-called Goss orientation grows preferentially, during secondary recrystallization annealing in the production process of the grain-oriented electrical steel sheet.

Conventionally, such grain-oriented electrical steel sheets have been manufactured by heating a slab containing around 4.5 mass % or less of Si and inhibitor components such as MnS, MnSe and AlN to 1300° C. or higher, and then once dissolving the inhibitor components, and then subjecting the slab to hot rolling to obtain a hot rolled steel sheet, and then subjecting the steel sheet to hot band annealing as necessary, and subsequent cold rolling once, or twice or more with intermediate annealing performed therebetween until reaching final sheet thickness, and then subjecting the steel sheet to primary recrystallization annealing in wet hydrogen atmosphere for primary recrystallization and decarburization, and then applying an annealing separator mainly composed of magnesia (MgO) thereon and performing final annealing at 1200° C. for around 5 hours for secondary recrystallization and purification of inhibitor components (e.g. see U.S. Pat. No. 1,965,559A (PTL 1), JPS4015644B (PTL 2) and JPSS113469B (PTL 3)).

As mentioned above, in the conventional production processes of grain-oriented electrical steel sheets, precipitates such as MnS, MnSe and AlN precipitates (inhibitor components) are contained in a slab, which is then heated at a high temperature exceeding 1300° C. to dissolve these inhibitor components once, and in the following process, the inhibitor components are finely precipitated to cause secondary recrystallization. As described above, in the conventional production processes of grain-oriented electrical steel sheets, since slab heating at a high temperature exceeding 1300° C. was required, significantly high manufacturing costs were inevitable and therefore recent demands of reduction in manufacturing costs could not be met.

In order to solve the above problem, for example, JP2782086B (PTL 4) proposes a method including preparing a slab containing 0.010% to 0.060% of acid-soluble Al (sol.Al), heating the slab at a low temperature, and performing nitridation in a proper nitriding atmosphere during the decarburization annealing process to use a precipitated (Al, Si)N as an inhibitor during secondary recrystallization. (Al,Si)N finely disperses in steel and serves as an effective inhibitor. However, since inhibitor strength is determined by the content of Al, there were cases where a sufficient grain growth inhibiting effect could not be obtained when the hitting accuracy of Al amount during steelmaking was insufficient. Many methods similar to the above where nitriding treatment is performed during intermediate process steps and (Al,Si)N or AlN is used as an inhibitor have been proposed and, recently, production methods where the slab heating temperature exceeds 1300° C. have also been disclosed.

On the other hand, investigation has also been made on techniques for causing secondary recrystallization without containing inhibitor components in the slab from the start. For example, as disclosed in JP2000129356A (PTL 5), a technique enabling secondary recrystallization without containing inhibitor components, a so-called inhibitor-less method was developed. This inhibitor-less method is a technique to use a highly purified steel and to cause secondary recrystallization by controlling the textures of the steel.

In this inhibitor-less method, high-temperature slab heating is unnecessary, and it is possible to produce grain-oriented electrical steel sheets at low cost. However, this method is characterized in that, due to the absence of an inhibitor, magnetic properties of the products were likely to vary with temperature variation and the like in intermediate process steps during manufacture. Texture control is an important factor in this technique and, accordingly, many techniques for texture control, such as warm rolling, have been proposed. However, when textures are not sufficiently controlled, the degree to which grains are accorded with the Goss orientation ((110)[001] orientation) after secondary recrystallization tends to be lower compared to when utilizing techniques using inhibitors, resulting in the lower magnetic flux density.

CITATION LIST

Patent Literature

PTL 1: U.S. Pat. No. 1,965,559A
PTL 2: JPS4015644B
PTL 3: JPS5113469B
PTL 4: JP2782086B
PTL 5: JP2000129356A

As mentioned above, with production methods for grain-oriented electrical steel sheets using an inhibitor-less method so far proposed, it was not always easy to stably obtain good magnetic properties.

By using components with Al content reduced to less than 100 ppm, equivalent to inhibitor-less components, avoiding high-temperature slab heating, and performing nitridation to precipitate silicon nitride ($Si_3N_4$) rather than AlN, and by allowing the silicon nitride to function to inhibit normal grain growth, the present invention enables significantly reducing variation of magnetic properties to industrially stably produce grain-oriented electrical steel sheets with good magnetic properties.

SUMMARY

In order to obtain a grain-oriented electrical steel sheet with reduced variation in magnetic properties while suppressing the slab heating temperature, the inventors of the present invention used an inhibitor-less method to prepare a primary recrystallized texture, precipitated silicon nitride therein by performing nitridation during an intermediate process step, and carried out investigation on using the silicon nitride as an inhibitor.

The inventors inferred that, if it is possible to precipitate silicon, which is normally contained in an amount of several % in a grain-oriented electrical steel sheet, as silicon nitride so as to be used as an inhibitor, a grain growth inhibiting effect would work equally well regardless of the amount of nitride-forming elements (Al, Ti, Cr, V, etc.) by controlling the degree of nitridation at the time of nitriding treatment.

On the other hand, unlike (Al,Si)N in which Si is dissolved in AlN, pure silicon nitride has poor matching with the crystal lattice of steel and has a complicated crystal structure with covalent bonds. Accordingly, it is known that to finely precipitate pure silicon nitride in grains is extremely difficult. For this reason, it follows that it would be difficult to finely precipitate pure silicon nitride in grains after performing nitridation as in conventional methods.

However, the inventors inferred that, by taking advantage of this characteristic, it would be possible to selectively precipitate silicon nitride on grain boundaries. Further, the inventors believed that, if it is possible to selectively precipitate silicon nitride on grain boundaries, a sufficient grain growth inhibiting effect would be obtained even in the state of coarse precipitates.

Based on the above ideas, the inventors conducted intense investigations starting from chemical compositions of the material, and extending to the nitrogen increase during nitriding treatment, heat treatment conditions for forming silicon nitride by diffusing nitrogen on the grain boundary, and the like. As a result, the inventors discovered a new usage of silicon nitride, and completed the present invention.

Specifically, the primary features of the present invention are as follows.

1. A production method for a grain-oriented electrical steel sheet, the method comprising:

subjecting a steel slab to hot rolling, without re-heating or after re-heating, to obtain a hot rolled sheet, the steel slab having a composition consisting of, by mass % or mass ppm, C: 0.08% or less, Si: 2.0% to 4.5%, Mn: 0.5% or less, S: less than 50 ppm, Se: less than 50 ppm, O: less than 50 ppm, sol.Al: less than 100 ppm, N: 80 ppm or less, and the balance being Fe and incidental impurities, and satisfying the relation of sol.Al (ppm)−N (ppm)×(26.98/14.00)≤30 ppm;

then subjecting the hot rolled sheet to annealing and rolling to obtain a cold rolled sheet of final sheet thickness;

then subjecting the cold rolled sheet to nitriding treatment, with a nitrogen increase (ΔN) being specified by the following formula (1) or (2), before, during or after primary recrystallization annealing;

then applying an annealing separator on the cold rolled sheet; and subjecting the cold rolled sheet to secondary recrystallization annealing:

$$\text{when } sol.Al-N\times(26.98/14.00)\leq 0,\ 50\ ppm\leq \Delta N\leq 1000\ ppm \quad (1)$$

,or $$\text{when } 0<sol.Al-N\times(26.98/14.00)\leq 30,\ (N-sol.Al\times 14.00/26.98+100)\leq \Delta N\leq (N-sol.Al\times 14.00/26.98+1000) \quad (2).$$

2. A production method for a grain-oriented electrical steel sheet, the method comprising:

subjecting a steel slab to hot rolling, without re-heating or after re-heating, to obtain a hot rolled sheet, the steel slab having a composition consisting of, by mass % or mass ppm, C: 0.08% or less, Si: 2.0% to 4.5%, Mn: 0.5% or less, S: less than 50 ppm, Se: less than 50 ppm, O: less than 50 ppm, sol.Al: less than 100 ppm, N: 80 ppm or less, and the balance being Fe and incidental impurities, and satisfying the relation of sol.Al (ppm)−N (ppm)×(26.98/14.00)≤30 ppm;

then subjecting the hot rolled sheet to annealing and rolling to obtain a cold rolled sheet of final sheet thickness;

then subjecting the cold rolled sheet to nitriding treatment, with a nitrogen increase (ΔN) being specified by the following formula (1) or (2), before, during or after primary recrystallization annealing;

then applying an annealing separator on the cold rolled sheet; and allowing N to diffuse into steel substrate, during or after the primary recrystallization annealing and before the start of secondary recrystallization, so as to precipitate silicon nitride with a precipitate size of 100 nm or more without containing Al, for use as inhibiting force for normal grain growth:

$$\text{when } sol.Al-N\times(26.98/14.00)\leq 0,\ 50\ ppm\leq \Delta N\leq 1000\ ppm \quad (1)$$

,or $$\text{when } 0<sol.Al-N\times(26.98/14.00)\leq 30,\ (N-sol.Al\times 14.00/26.98+100)\leq \Delta N\leq (N-sol.Al\times 14.00/26.98+1000) \quad (2).$$

3. The production method for a grain-oriented electrical steel sheet according to aspect 1 or 2, wherein the steel slab further contains, by mass %, one or more of Ni: 0.005% to 1.50%, Sn: 0.01% to 0.50%, Sb: 0.005% to 0.50%, Cu: 0.01% to 0.50%, Cr: 0.01% 1.50%, P: 0.0050% to 0.50%, Mo: 0.01% to 0.50% and Nb: 0.0005% to 0.0100%.

4. A primary recrystallized steel sheet for production of a grain-oriented electrical steel sheet, wherein the composition thereof satisfies a composition range of, by mass % or mass ppm, C: 0.08% or less, Si: 2.0% to 4.5% and Mn: 0.5% or less, with S, Se and O: each less than 50 ppm, sol.Al: less than 100 ppm, N: 50 ppm or more and 1080 ppm or less, and the balance being Fe and incidental impurities.

5. The primary recrystallized steel sheet for production of a grain-oriented electrical steel sheet according to aspect 4, wherein the primary recrystallized steel sheet further contains by mass %, one or more of Ni: 0.005% to 1.50%, Sn: 0.01% to 0.50%, Sb: 0.005% to 0.50%, Cu: 0.01% to 0.50%, Cr: 0.01% to 1.50%, P: 0.0050% to 0.50%, Mo: 0.01% to 0.50% and Nb: 0.0005% to 0.0100%.

According to the present invention, it is possible to industrially stably produce grain-oriented electrical steel sheets having good magnetic properties with significantly reduced variation, without the need of high-temperature slab heating.

Further, in the present invention, pure silicon nitride which is not precipitated compositely with Al is used, and therefore when performing purification, it is possible to achieve purification of steel simply by purifying only nitrogen, which diffuses relatively quickly.

Further, when using Al or Ti as precipitates as in conventional methods, control in ppm order was necessary from the perspective of achieving desired purification and guaranteeing an inhibitor effect. However, when using Si as precipitates as in the present invention, such control is completely unnecessary during steelmaking.

BRIEF DESCRIPTION OF THE DRAWINGS

The present invention will be further described below with reference to the accompanying drawings, wherein.

DETAILED DESCRIPTION

Figure 1A:
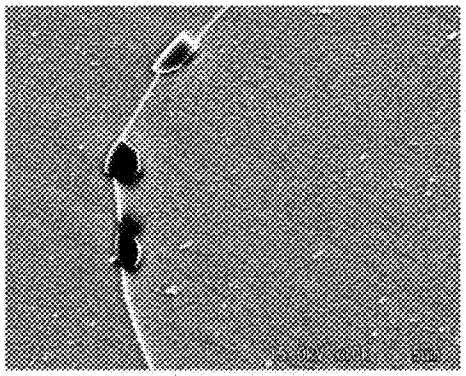
FIG. 1 shows electron microscope photographs of a microstructure subjected to decarburization annealing, followed by nitriding treatment with the nitrogen increase of 100 ppm ((a) of FIG. 1) and 500 ppm ((b) of FIG. 1), subsequently heated to 800° C. at a predetermined heating rate, and then immediately subjected to water-cooling, as well as a graph ((c) of FIG. 1) showing the identification results of precipitates in the above microstructure obtained by EDX (energy-dispersive X-ray spectrometry)

Details of the present invention are described below.

First, reasons for limiting the chemical compositions of the steel slab to the aforementioned range in the present invention will be explained. Here, unless otherwise specified, indications of "%" and "ppm" regarding components shall each stand for "mass %" and "mass ppm".

C: 0.08% or Less

C is a useful element in terms of improving primary recrystallized textures. However, if the content thereof exceeds 0.08%, primary recrystallized textures deteriorate. Therefore C content is limited to 0.08% or less. From the viewpoint of magnetic properties, the preferable C content is in the range of 0.01% to 0.06%. If the required level of magnetic properties is not very high, C content may be set to 0.01% or less for the purpose of omitting or simplifying decarburization during primary recrystallization annealing.

Si: 2.0% to 4.5%

Si is a useful element which improves iron loss properties by increasing electrical resistance. However, if the content thereof exceeds 4.5%, it causes significant deterioration of cold rolling manufacturability, and therefore Si content is limited to 4.5% or less. On the other hand, for enabling Si to function as a nitride-forming element Si content needs to be 2.0% or more. Further, from the viewpoint of iron loss properties, the preferable Si content is in the range of 2.0% to 4.5%.

Mn: 0.5% or Less

Since Mn provides an effect of improving hot workability during manufacture, it is preferably contained in the amount of 0.01% or more. However, if the content thereof exceeds 0.5%, primary recrystallized textures worsen and magnetic properties deteriorate. Therefore Mn content is limited to 0.5% or less.

S, Se and O: Less than 50 ppm (Individually)

If the content of each of S, Se and O is 50 ppm or more, it becomes difficult to develop secondary recrystallization. This is because primary recrystallized textures are made non-uniform by coarse oxides or MnS and MnSe coarsened by slab heating. Therefore, S, Se and O are all suppressed to less than 50 ppm. The contents of these elements may also be 0 ppm.

Sol.Al: Less than 100 ppm

Al forms a dense oxide film on a surface of the steel sheet, and could make it difficult to control the degree of nitridation at the time of nitriding treatment or obstruct decarburization. Therefore Al content is suppressed to less than 100 ppm in terms of sol.Al. However, Al, which has high affinity with oxygen, is expected to bring about such effects as to reduce the amount of dissolved oxygen in steel and to reduce oxide inclusions which would lead to deterioration of magnetic properties, when added in minute quantities during steelmaking. Therefore, in order to curb deterioration of magnetic properties, it is advantageous to add Al in an amount of 10 ppm or more. The content thereof may also be 0 ppm.

N: 80 ppm or Less, and Sol.Al (ppm)−N (ppm)×(26.98/14.00)≤30 ppm

In the present invention, since textures are prepared by applying an inhibitor-less production method, it is necessary to suppress N content to 80 ppm or less. If N content exceeds 80 ppm, the influence of grain boundary segregation or formation of minute amounts of nitrides causes harmful effects such as deterioration in textures. Further, since N could become the cause of defects such as blisters at the time of slab heating, N content needs to be suppressed to 80 ppm or less. The content thereof is preferably 60 ppm or less.

In the present invention, simply suppressing N content to 80 ppm or less is insufficient, and in relation to sol.Al content, N content needs to be limited to the range of sol.Al (ppm)−N (ppm)×(26.98/14.00)≤30 ppm.

The present invention has a feature that silicon nitride is precipitated by nitriding treatment. However, if Al remains excessively, it often precipitates in the form of (Al,Si)N after nitriding treatment, thereby preventing precipitation of pure silicon nitride.

However, if N content is controlled in relation to the sol.Al content within the range of sol.Al−N×(26.98/14.00)≤0, in other words, if N is contained in steel in an amount equal to or more than the amount in which N precipitates as AlN with respect to the amount of Al contained in steel, it is possible to fix Al as precipitates of AlN before nitriding treatment. In this way, N added to steel by nitriding treatment (ΔN) can be used only for the formation of silicon nitride. Here, ΔN stands for an increase in nitrogen content in steel resulting from nitriding treatment.

On the other hand, when the value of sol.Al−N×(26.98/14.00) is in the range of more than 0 and 30 or less, more excess nitrogen (ΔN) is required in order to form pure silicon nitride after nitriding treatment.

Further, if the value of sol.Al−N×(26.98/14.00) exceeds 30, the influence of AlN and (Al,Si)N which finely precipitate due to N added during nitriding treatment becomes more pronounced, excessively raises the secondary recrystallization temperature, and causes secondary recrystallization failure. Therefore, the value of sol.Al−N×(26.98/14.00) needs to be suppressed to 30 ppm or less.

The basic components are as described above. In the present invention, the following elements may be contained according to necessity as components for improving magnetic properties in an even more industrially reliable manner.

Ni: 0.005% to 1.50%

Ni provides an effect of improving magnetic properties by enhancing the uniformity of texture of the hot rolled sheet, and, to obtain this effect, it is preferably contained in an amount of 0.005% or more. On the other hand, if the content thereof exceeds 1.50%, it becomes difficult to develop secondary recrystallization, and magnetic properties deteriorate. Therefore, Ni is preferably contained in a range of 0.005% to 1.50%.

Sn: 0.01% to 0.50%

Sn is a useful element which improves magnetic properties by suppressing nitridation and oxidization of the steel sheet during secondary recrystallization annealing and facilitating secondary recrystallization of crystal grains having good crystal orientation, and to obtain this effect, it is preferably contained in an amount of 0.01% or more. On the other hand, if it is contained in an amount exceeding 0.50%, cold rolling manufacturability deteriorates. Therefore, Sn is preferably contained in the range of 0.01% to 0.50%.

Sb: 0.005% to 0.50%

Sb is a useful element which effectively improves magnetic properties by suppressing nitridation and oxidization of the steel sheet during secondary recrystallization annealing and facilitating secondary recrystallization of crystal grains having good crystal orientation, and to obtain this effect, it is preferably contained in an amount of 0.005% or more. On the other hand, if it is contained in an amount exceeding 0.5%, cold rolling manufacturability deteriorates. Therefore, Sb is preferably contained in the range of 0.005% to 0.50%.

Cu: 0.01% to 0.50%

Cu provides an effect of effectively improving magnetic properties by suppressing oxidization of the steel sheet during secondary recrystallization annealing and facilitating secondary recrystallization of crystal grains having good crystal orientation, and to obtain this effect, it is preferably contained in an amount of 0.01% or more. On the other hand, if it is contained in an amount exceeding 0.50%, hot rolling manufacturability deteriorates. Therefore, Cu is preferably contained in the range of 0.01% to 0.50%.

Cr: 0.01% to 1.50%

Cr provides an effect of stabilizing formation of forsterite films, and, to obtain this effect, it is preferably contained in an amount of 0.01% or more. On the other hand, if the content thereof exceeds 1.50%, it becomes difficult to develop secondary recrystallization, and magnetic properties deteriorate. Therefore, Cr is preferably contained in the range of 0.01% to 1.50%.

P: 0.0050% to 0.50%

P provides an effect of stabilizing formation of forsterite films, and, to obtain this effect, it is preferably contained in an amount of 0.0050% or more. On the other hand, if the content thereof exceeds 0.50%, cold rolling manufacturability deteriorates. Therefore, P is preferably contained in a range of 0.0050% to 0.50%.

Mo: 0.01% to 0.50%, Nb: 0.0005% to 0.0100%

Mo and Nb both have an effect of suppressing generation of scabs after hot rolling by for example, suppressing cracks caused by temperature change during slab heating. These elements become less effective for suppressing scabs, however, unless Mo content is 0.01% or more and Nb content is 0.0005% or more. On the other hand, if Mo content exceeds 0.50% and Nb content exceeds 0.0100%, they cause deterioration of iron loss properties if they remain in the finished product as, for example, carbide or nitride. Therefore, it is preferable for each element to be contained in the above mentioned ranges.

Next, the production method for the present invention will be explained.

A steel slab adjusted to the above preferable chemical composition range is subjected to hot rolling without being re-heated or after being re-heated. When re-heating the slab, the re-heating temperature is preferably approximately in the range of 1000° C. to 1300° C. This is because slab heating at a temperature exceeding 1300° C. is not effective in the present invention where little inhibitor element is contained in steel in the form of a slab, and only causes an increase in costs, while slab heating at a temperature of lower than 1000° C. increases the rolling load, which makes rolling difficult.

Then, the hot rolled sheet is subjected to hot band annealing as necessary, and subsequent cold rolling once, or twice or more with intermediate annealing performed therebetween to obtain a final cold rolled sheet. The cold rolling may be performed at room temperature. Alternatively, warm rolling where rolling is performed with the steel sheet temperature raised to a temperature higher than room temperature for example, around 250° C. is also applicable.

Then, the final cold rolled sheet is subjected to primary recrystallization annealing.

The purpose of primary recrystallization annealing is to anneal the cold rolled sheet with a rolled microstructure for primary recrystallization to adjust the grain size of the primary recrystallized grains so that they are of optimum grain size for secondary recrystallization. In order to do so, it is preferable to set the annealing temperature of primary recrystallization annealing approximately in the range of 800° C. to below 950° C. Further, by setting the annealing atmosphere during primary recrystallization annealing to an atmosphere of wet hydrogen-nitrogen or wet hydrogen-argon, primary recrystallization annealing may be combined with decarburization annealing.

Further, before, during or after the above primary recrystallization annealing, nitriding treatment is performed. As long as the degree of nitridation is controlled, any means of nitridation can be used and there is no particular limitation. For example, as performed in the past, gas nitriding may be performed directly in the form of a coil using $NH_3$ atmosphere gas, or continuous gas nitriding may be performed on a running strip. Further, it is also possible to utilize salt bath nitriding with higher nitriding ability than gas nitriding. Here, a preferred salt bath for salt bath nitriding is a salt bath mainly composed of cyanate.

The important point of the above nitriding treatment is the formation of a nitride layer on the surface layer. In order to suppress diffusion into steel, it is preferable to perform nitriding treatment at a temperature of 800° C. or lower, yet, by shortening the duration of the treatment (e.g. to around 30 seconds), it is possible to form a nitride layer only on the surface even if the treatment is performed at a higher temperature.

In the present invention, the increase in nitrogen content in steel resulting from the above nitriding treatment (also referred to as "nitrogen increase" (or "ΔN")) differs depending on the N content and the sol.Al content before the treatment.

That is, if the N content and the sol.Al content satisfy the relation of $sol.Al-N\times(26.98/14.00)\leq 0$, it is possible to allow N in steel to precipitate as AlN beforehand, and thus nitrogen increased by nitriding treatment is used only for the formation of silicon nitride containing no Al. In this case, the nitrogen increase (ΔN) caused by nitriding treatment is in the range of the following formula (I).

$$50\ \text{ppm}\leq\Delta N\leq 1000\ \text{ppm} \quad (1)$$

On the other hand, if the N content and the sol.Al content satisfy the relation of $0<sol.Al-N\times(26.98/14.00)\leq 30$, N increased by nitriding treatment precipitates as (Al,Si)N with dissolved AlN or Si which are thermodynamically stable compared to silicon nitride. Therefore, more excess nitrogen is required for precipitating a proper amount of silicon nitride. In particular, the following formula (2) should be satisfied.

$$(N-sol.Al\times 14.00/26.98+100)\leq\Delta N\leq(N-sol.Al\times 14.00/26.98+1000) \quad (2)$$

If the nitrogen increase (ΔN) is less than the lower limits of formulas (1) and (2), a sufficient effect cannot be obtained, whereas if it exceeds the upper limits, an excessive amount of silicon nitride precipitates and secondary recrystallization will not occur.

Further, nitriding treatment can be applied before, during or after primary recrystallization annealing. However, AlN may partially dissolve during annealing before final cold rolling, in which case the steel sheet is cooled in the presence of sol.Al. Therefore, if nitriding treatment is applied before primary recrystallization annealing, the state of precipitation of the obtained steel sheet may deviate from the ideal state under the influence of the remained sol.Al. In view of the above, precipitation can be controlled in a more stable manner if nitriding treatment is performed at a timing, preferably after the heating of primary recrystallization annealing where dissolved Al precipitates as AlN again, namely, during primary recrystallization annealing or after annealing.

After subjecting the steel sheet to the above primary recrystallization annealing and nitriding treatment, an annealing separator is applied on a surface of the steel sheet. In order to form a forsterite film on the surface of the steel sheet after secondary recrystallization annealing, it is necessary to use an annealing separator mainly composed of magnesia (MgO). However, if there is no need to form a forsterite film, any suitable oxide with a melting point higher than the secondary recrystallization annealing temperature, such as alumina ($Al_2O_3$) or calcia (CaO), can be used as the main component of the annealing separator.

Subsequently, secondary recrystallization annealing is performed. During this secondary recrystallization annealing, it is necessary to set the staying time in the temperature range of 300° C. to 800° C. in the heating process to 5 hours or more to 150 hours or less. During the staying time, the nitride layer in the surface layer is decomposed and N diffuses into the steel. As for the chemical composition of the present invention, Al which is capable of forming AlN does not remain, and therefore N as a grain boundary segregation element diffuses into steel using grain boundaries as diffusion paths.

Silicon nitride has poor matching with the crystal lattice of steel (i.e. the misfit ratio is high), and therefore the precipitation rate is very low. Nevertheless, since the purpose of precipitation of silicon nitride is to inhibit normal grain growth, it is necessary to have a sufficient amount of silicon nitride selectively precipitated at grain boundaries at the stage of 800° C. at which normal grain growth proceeds. Regarding this point, silicon nitride cannot precipitate in grains, yet by setting the staying time in the temperature range of 300° C. to 800° C. to 5 hours or more, it is possible to selectively precipitate silicon nitride at grain boundaries by allowing silicon nitride to be bound to N diffusing from the grain boundaries. Although an upper limit of the staying time is not necessarily required, performing annealing for more than 150 hours is unlikely to increase the effect. Therefore, the upper limit is set to 150 hours in the present invention. Further, as the annealing atmosphere, either of $N_2$, Ar, $H_2$ or a mixed gas thereof is applicable.

As described above, with a grain-oriented electrical steel sheet obtained by applying the above process to a slab that contains a limited amount of Al in steel, suppresses precipitation of AlN or (Al,Si)N caused by nitriding treatment, and contains little inhibitor components such as MnS or MnSe, it is possible to selectively precipitate coarse silicon nitride (with a precipitate size of 100 nm or more), as compared to conventional inhibitors, on grain boundaries at the stage during the heating process of secondary recrystallization annealing before secondary recrystallization starts. Although there is no particular limit on the upper limit of the precipitate size of silicon nitride, it is preferably 5 μm or less.

Figure 1B:
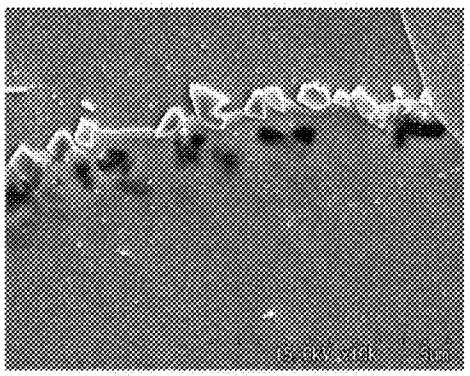
Figure 1C:
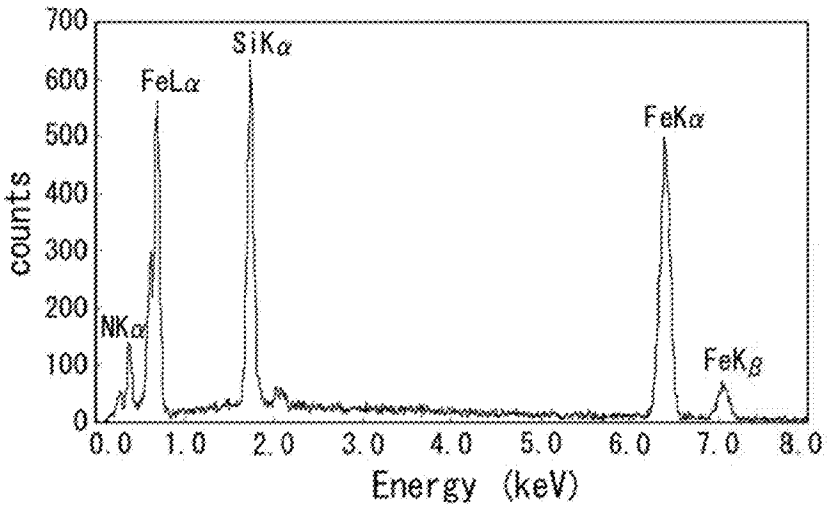

FIG. 1 shows electron microscope photographs for observation and identification of a microstructure subjected to decarburization annealing, followed by nitriding treatment with the nitrogen increase of 100 ppm ((a) of FIG. 1) and 500 ppm ((b) of FIG. 1), subsequently heated to 800° C. at a heating rate such that the staying time in the temperature range of 300° C. to 800° C. is 8 hours, and then immediately subjected to water-cooling, which were observed and identified using an electron microscope. Further, graph (c) in FIG. 1 shows the results of identification of precipitates in the aforementioned microstructure by EDX (energy-dispersive X-ray spectrometry). It can be seen from FIG. 1 that unlike fine precipitates conventionally used (with a precipitate size of smaller than 100 nm), even the smallest one of the coarse silicon nitride precipitates on the grain boundary has a precipitate size greater than 100 nm.

Further, samples were subjected to the process steps up to primary recrystallization annealing combined with decarburization in a lab, using steel ingot A prepared by steelmaking with Si: 3.2%, sol.Al<5 ppm, and N: 10 ppm as steel components, and steel ingot B prepared by steelmaking with Si: 3.2%, sol.Al: 150 ppm, and N: 10 ppm as steel components. The samples were then subjected to gas nitriding treatment using $NH_3$—$N_2$ combined gas with a nitrogen increase of 200 ppm. Microstructures of the samples after the nitriding treatment thus obtained were observed using an electron microscope. Then, the samples after the nitriding treatment were heated to 800° C. with the same heat pattern as secondary recrystallization annealing, and then subjected to water-cooling. Microstructures of the samples thus obtained were observed under an electron microscope.

Figure 2:
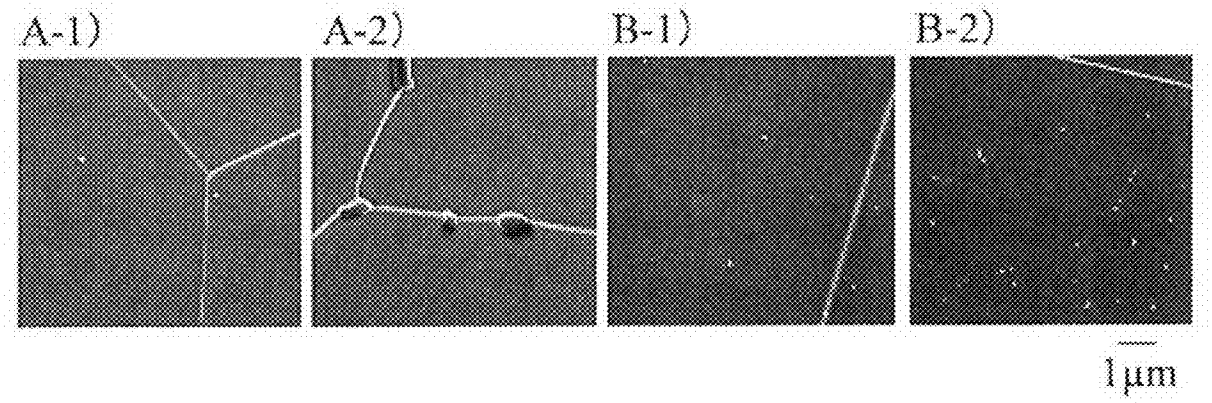
FIG. 2 shows electron microscope photographs of steel ingots A, B (A-1, B-1) after nitriding treatment and after heating (A-2, B-2).

The observation results are shown in FIG. 2. In FIG. 2, A-1 and B-1 are electron microscope photographs of steel ingots A and B after nitriding treatment, and A-2 and B-2 are electron microscope photographs of steel ingots A and B after heating.

It can be seen that for steel ingot A which does not contain Al, little precipitates are observed after nitriding treatment (A-1), while after heating and water-cooling (A-2), $Si_3N_4$ with a precipitate size of 100 nm or more precipitates on the grain boundaries. On the other hand, for steel ingot B which contains Al, although precipitates can hardly be identified after nitriding treatment (B-1) as in the case of steel ingot A, it is observed that (Al,Si)N of conventional type precipitate in the grain after heating (B-2).

The use of pure silicon nitride which is not precipitated compositely with Al which is a feature of the present invention, has significantly high stability from the viewpoint of effectively utilizing Si which exists in steel in order of several % and provides an effect of improving iron loss properties. That is, components such as Al or Ti, which have been used in conventional techniques, have high affinity with nitrogen and provide precipitates which still remain stable at high temperature. Therefore, these components tend to remain in steel finally, and the remaining components could become the cause of deteriorating magnetic properties.

However, when using silicon nitride, it is possible to achieve purification of precipitates which are harmful to magnetic properties simply by purifying only nitrogen, which diffuses relatively quickly. Further, when using Al or Ti, control in ppm order is necessary from the viewpoint that purification is eventually required and that an inhibitor effect must surely be obtained. However, when using Si, such control is unnecessary during steelmaking, and this is also an important feature of the present invention.

In production, it is clear that utilizing the heating process of secondary recrystallization is most effective for precipitation of silicon nitride in terms of energy efficiency, yet it is also possible to selectively precipitate silicon nitride on grain boundaries by utilizing a similar heat cycle. Therefore, in production, it is also possible to perform silicon nitride dispersing annealing before time consuming secondary recrystallization.

After the above secondary recrystallization annealing, it is possible to further apply and bake an insulation coating on the surface of the steel sheet. Such an insulation coating is not limited to a particular type, and any conventionally known insulation coating is applicable. For example, preferred methods are described in JPSS5079442A and JPS4839338A where a coating liquid containing phosphate-chromate-colloidal silica is applied on a steel sheet and then baked at a temperature of around 800° C.

It is possible to correct the shape of the steel sheet by flattening annealing, and further to combine the flattening annealing with baking treatment of the insulation coating.

EXAMPLES

Example 1

A steel slab containing C: 0.06%, Si: 3.3%, Mn: 0.08%, S: 0.001%, Se: 5 ppm or less, O: 11 ppm, Cu: 0.05% and Sb: 0.01% as well as Al and N at a ratio shown in Table 1, with the balance including Fe and incidental impurities, was heated at 1100° C. for 30 minutes, and then subjected to hot rolling to obtain a hot rolled sheet with a thickness of 2.2 mm. Then, the steel sheet was subjected to annealing at 1000° C. for 1 minute, and subsequent cold rolling to obtain a final sheet thickness of 0.23 mm. Then, samples of the size of 100 mm×400 mm were collected from the center part of the obtained cold rolled coil, and primary recrystallization annealing combined with decarburization was performed in a lab. For some of the samples, primary recrystallization annealing combined with decarburization and nitriding (continuous nitriding treatment: nitriding treatment utilizing a mixed gas of $NH_3$, $N_2$ and $H_2$) was performed. Then, samples which were not subjected to nitriding were subjected to nitriding treatment in conditions shown in Table 1 (batch processing: nitriding treatment with salt bath using salt mainly composed of cyanate, and nitriding treatment using a mixed gas of $NH_3$ and $N_2$) to increase the nitrogen content in steel. The nitrogen content was quantified by chemical analysis for samples with full thickness as well as samples with surface layers (on both sides) removed by grinding 3 μm off from the surfaces of the steel sheet with sand paper.

Twenty-one steel sheet samples were prepared for each condition, and an annealing separator mainly composed of MgO and containing 5% of $TiO_2$ was made into a water slurry state and then applied, dried and baked on the samples. Among them, twenty samples were subjected to final annealing, and then a phosphate-based insulation tension coating was applied and baked thereon to obtain products.

For the obtained products, the magnetic flux density $B_8$ (T) at a magnetizing force of 800 A/m was evaluated. Magnetic properties of each condition were evaluated from the average value of twenty samples. The remaining one sample was heated to 800° C. with the same heat pattern as final annealing, and then removed and directly subjected to water quenching. Regarding these samples, silicon nitride in the microstructure was observed using an electron microscope and the average precipitate size of fifty silicon nitride precipitates was measured.

TABLE 1

| | Slab Component | | Nitriding Treatment | | | Analysis Value of N after Nitriding | | Nitrogen Increase | Silicon Nitride Average | Magnetic | |
|---|---|---|---|---|---|---|---|---|---|---|---|
| | Al (mass ppm) | N (mass ppm) | Treatment Method | Treatment Temperature (° C.) | Treatment Time (s) | at Overall Thickness (mass ppm) | after Removing Surface Layer (mass ppm) | ΔN (mass ppm) | Grain Size (nm) | Properties $B_8$ (T) | Remarks |
| Condition 1 | 50 | 30 | None | — | — | 30 | 30 | 0 | — | 1.865 | Comparative Example |
| Condition 2 | 50 | 30 | Salt Bath by Batch | 450 | 30 | 70 | 30 | 40 | 85 | 1.878 | Comparative Example |
| Condition 3 | 50 | 30 | Salt Bath by Batch | 450 | 60 | 85 | 35 | 55 | 200 | 1.905 | Inventive Example |
| Condition 4 | 50 | 30 | Salt Bath by Batch | 480 | 100 | 200 | 40 | 170 | 650 | 1.910 | Inventive Example |
| Condition 5 | 50 | 30 | Salt Bath by Batch | 480 | 180 | 300 | 45 | 270 | 700 | 1.912 | Inventive Example |
| Condition 6 | 50 | 25 | None | — | — | 25 | 25 | 0 | — | 1.876 | Comparative Example |
| Condition 7 | 50 | 25 | Salt Bath by Batch | 500 | 100 | 90 | 40 | 65 | 80 | 1.881 | Comparative Example |
| Condition 8 | 50 | 25 | Salt Bath by Batch | 500 | 300 | 130 | 40 | 105 | 400 | 1.908 | Inventive Example |
| Condition 9 | 50 | 25 | Salt Bath by Batch | 600 | 20 | 300 | 50 | 275 | 420 | 1.913 | Inventive Example |
| Condition 10 | 50 | 25 | Salt Bath by Batch | 600 | 180 | 600 | 60 | 575 | 700 | 1.916 | Inventive Example |
| Condition 11 | 80 | 25 | None | — | — | 25 | 25 | 0 | — | 1.876 | Comparative Example |
| Condition 12 | 80 | 25 | Salt Bath by Batch | 600 | 20 | 300 | 50 | 275 | 150 | 1.822 | Comparative Example |

TABLE 1-continued

| | Slab Component | | Nitriding Treatment | | | Analysis Value of N after Nitriding | | | Silicon | | |
|---|---|---|---|---|---|---|---|---|---|---|---|
| | Al (mass ppm) | N (mass ppm) | Treatment Method | Treatment Temperature (° C.) | Treatment Time (s) | at Overall Thickness (mass ppm) | after Removing Surface Layer (mass ppm) | Nitrogen Increase ΔN (mass ppm) | Nitride Average Grain Size (nm) | Magnetic Properties $B_8$ (T) | Remarks |
| Condition 13 | 80 | 40 | None | — | — | 40 | 40 | 0 | — | 1.883 | Comparative Example |
| Condition 14 | 80 | 40 | Batch Gas | 450 | 60 | 120 | 45 | 80 | 70 | 1.894 | Comparative Example |
| Condition 15 | 80 | 40 | Batch Gas | 450 | 200 | 300 | 50 | 260 | 350 | 1.913 | Inventive Example |
| Condition 16 | 80 | 40 | Batch Gas | 450 | 300 | 500 | 50 | 460 | 600 | 1.915 | Inventive Example |
| Condition 17 | 80 | 40 | Batch Gas | 520 | 240 | 1050 | 200 | 1010 | 700 | 1.752 | Comparative Example |
| Condition 18 | 80 | 45 | None | — | — | 45 | 45 | 0 | — | 1.885 | Comparative Example |
| Condition 19 | 80 | 45 | Batch Gas | 450 | 60 | 120 | 45 | 75 | 100 | 1.902 | Inventive Example |
| Condition 20 | 80 | 45 | Batch Gas | 450 | 200 | 300 | 50 | 255 | 380 | 1.910 | Inventive Example |
| Condition 21 | 80 | 45 | Batch Gas | 450 | 300 | 500 | 50 | 455 | 700 | 1.912 | Inventive Example |
| Condition 22 | 80 | 45 | Batch Gas | 520 | 240 | 1050 | 200 | 1005 | 800 | 1.718 | Comparative Example |
| Condition 23 | 80 | 40 | None | — | — | 40 | 40 | 0 | — | 1.886 | Comparative Example |
| Condition 24 | 60 | 40 | Continuous Gas | 700 | 10 | 100 | 40 | 60 | 150 | 1.905 | Inventive Example |
| Condition 25 | 80 | 40 | Continuous Gas | 700 | 10 | 100 | 40 | 60 | 70 | 1.881 | Comparative Example |

As can be seen in Table 1, it is clear that magnetic properties are improved in the inventive examples compared to those produced in the inhibitor-less manufacturing process.

Example 2

A steel slab containing components shown in Table 2 (the contents of S, Se, and O each being less than 50 ppm) was heated at 1200° C. for 20 minutes, subjected to hot rolling to obtain a hot rolled sheet with a thickness of 2.0 mm. Then, the hot rolled sheet was subjected to annealing at 1000° C. for 1 minute, then cold rolling to have a sheet thickness of 1.5 mm, then intermediate annealing at 1100° C. for 2 minutes, then cold rolling to obtain a final sheet thickness of 0.27 mm, and then decarburization annealing where the cold rolled sheet was retained at an annealing temperature of 820° C. for 2 minutes, in an atmosphere of $P(H_2O)/P(H_2)=0.3$. Then, some of the coils were subjected to nitriding treatment (in $NH_3$ atmosphere) by batch processing to increase the N content in steel by 70 ppm or 550 ppm. Then, annealing separators, each mainly composed of MgO with 10% of $TiO_2$ added thereto, were mixed with water, made into slurry state and applied thereon, respectively, which in turn were wound into coils, and then subjected to final annealing at a heating rate where the staying time in the temperature range of 300° C. to 800° C. was 30 hours. Then, a phosphate-based insulation tension coating was applied and baked thereon, and flattening annealing was performed for the purpose of flattening the resulting steel strips to obtain products.

Epstein test pieces were collected from the product coils thus obtained and the magnetic flux density Bs thereof was measured. The measurement results are shown in Table 2.

TABLE 2

| | Chemical Composition | | | | | | Nitrogen | Magnetic | |
|---|---|---|---|---|---|---|---|---|---|
| No. | Si (mass %) | C (mass ppm) | Mn (mass %) | sol. Al (mass ppm) | N (mass ppm) | Others (mass %) | Increase ΔN (mass ppm) | Properties $B_8$ (T) | Remarks |
| 1 | 3.35 | 400 | 0.03 | 180 | 70 | — | None | 1.802 | Comparative Example |
| 2 | 3.35 | 400 | 0.03 | 180 | 70 | — | 550 | 1.836 | Comparative Example |
| 3 | 3.35 | 400 | 0.03 | 80 | 30 | — | None | 1.872 | Comparative Example |
| 4 | 3.35 | 400 | 0.03 | 80 | 30 | — | 70 | 1.875 | Comparative Example |
| 5 | 3.35 | 400 | 0.03 | 80 | 30 | — | 550 | 1.906 | Inventive Example |

TABLE 2-continued

| No. | Chemical Composition Si (mass %) | C (mass ppm) | Mn (mass %) | sol. Al (mass ppm) | N (mass ppm) | Others (mass %) | Nitrogen Increase ΔN (mass ppm) | Magnetic Properties $B_8$ (T) | Remarks |
|---|---|---|---|---|---|---|---|---|---|
| 6 | 2.85 | 500 | 0.03 | 80 | 55 | — | None | 1.873 | Comparative Example |
| 7 | 2.85 | 500 | 0.03 | 80 | 55 | — | 70 | 1.908 | Inventive Example |
| 8 | 2.85 | 500 | 0.03 | 80 | 55 | — | 550 | 1.911 | Inventive Example |
| 9 | 3.10 | 550 | 0.08 | 70 | 35 | — | None | 1.881 | Comparative Example |
| 10 | 3.10 | 550 | 0.08 | 70 | 35 | — | 550 | 1.916 | Inventive Example |
| 11 | 3.10 | 550 | 0.08 | 70 | 35 | Ni: 0.01, Sb: 0.02 | 550 | 1.927 | Inventive Example |
| 12 | 3.10 | 550 | 0.08 | 70 | 35 | Sn: 0.03 | 550 | 1.927 | Inventive Example |
| 13 | 3.10 | 550 | 0.08 | 70 | 35 | Cr: 0.03, Mo: 0.05 | 550 | 1.923 | Inventive Example |
| 14 | 3.10 | 550 | 0.08 | 70 | 35 | Cu: 0.05 | 550 | 1.924 | Inventive Example |
| 15 | 3.10 | 550 | 0.08 | 70 | 35 | P: 0.01, Nb: 0.001 | 550 | 1.924 | Inventive Example |

It can be seen from Table 2 that all of the inventive examples obtained in accordance with the present invention exhibited high magnetic flux density.

The invention claimed is:

1. A production method for a grain-oriented electrical steel sheet, the method comprising:

subjecting a steel slab to hot rolling, without re-heating or after re-heating, to obtain a hot rolled sheet, the steel slab having a composition comprising, by mass % or mass ppm:

C: 0.08% or less,

Si: 2.0% to 4.5%,

Mn: 0.5% or less,

S: less than 50 ppm,

Se: less than 50 ppm,

O: less than 50 ppm, sol.Al: less than 100 ppm,

N: 80 ppm or less, and the balance being Fe and incidental impurities, where the relationship sol.Al (ppm)−N (ppm)×(26.98/14.00)≤30 ppm is satisfied;

then subjecting the hot rolled sheet to annealing and rolling to obtain a cold rolled sheet of final sheet thickness;

then subjecting the cold rolled sheet to nitriding treatment, with a nitrogen increase (ΔN) being specified by the following formula (1) or (2), before, during or after primary recrystallization annealing:

$$\text{when } sol.Al-N\times(26.98/14.00)\leq 0,\ 50\ ppm\leq \Delta N\leq 1000\ ppm \quad (1),$$

$$\text{when } 0<sol.Al-N\times(26.98/14.00)\leq 30,$$

$$(N-sol.Al\times 14.00/26.98+100)\leq \Delta N\leq (N-sol.Al\times 14.00/26.98+1000) \quad (2);$$

then applying an annealing separator on the cold rolled sheet; and allowing N to diffuse into a steel substrate during a heating process of a secondary recrystallization, so as to precipitate silicon nitride at grain boundaries with a precipitate size of 100 nm or more without containing Al, in order to provide an inhibiting force for normal grain growth, wherein a staying time in a temperature range of 300° C. to 800° C. in the heating process is 5 hours or more, the nitriding treatment is performed at a temperature of 800° C. or lower, and 86% or more of the nitrogen introduced into the cold rolled steel sheet localizes in a surface region of 3 μm thick in the nitriding treatment.

2. The production method for a grain-oriented electrical steel sheet according to claim 1, wherein the steel slab further comprises, by mass %, one or more of Ni: 0.005% to 1.50%, Sn: 0.01% to 0.50%, Sb: 0.005% to 0.50%, Cu: 0.01% to 0.50%, Cr: 0.01% 1.50%, P: 0.0050% to 0.50%, Mo: 0.01% to 0.50% and Nb: 0.0005% to 0.0100%.

* * * * *